US006420668B1

(12) United States Patent
Lee

(10) Patent No.: US 6,420,668 B1
(45) Date of Patent: Jul. 16, 2002

(54) NO-FLOAT PUMP SWITCH

(75) Inventor: Rory G. Lee, Detroit Lakes, MN (US)

(73) Assignee: S.J. Electro Systems, Inc., Detroit Lakes, MN (US)

( * ) Notice: Subject to any disclaimer, the term of this patent is extended or adjusted under 35 U.S.C. 154(b) by 0 days.

(21) Appl. No.: 09/679,129

(22) Filed: Oct. 4, 2000

(51) Int. Cl.[7] ..... H01H 35/40
(52) U.S. Cl. ..... 200/83 L; 200/83 R; 200/83 A
(58) Field of Search ..... 200/83 L, 83 R, 200/83 A, 83 P, 84 B

(56) References Cited

U.S. PATENT DOCUMENTS 4,220,836 A * 9/1980 Hersey ..... 200/83 P
4,344,741 A * 8/1982 Taki ..... 417/28
4,499,347 A * 2/1985 Richards ..... 200/81.9 M
4,877,048 A * 10/1989 Oltean et al. ..... 137/225
5,055,641 A * 10/1991 Richards ..... 200/81.9 M
5,173,579 A * 12/1992 Nimberger ..... 200/83 L

* cited by examiner

*Primary Examiner*—Elvin Enad
*Assistant Examiner*—Kyung S. Lee
(74) *Attorney, Agent, or Firm*—Vidas, Arrett & Steinkraus P.A.

(57) ABSTRACT

A control apparatus for turning on and off an electrical load device which includes an enclosure having open top and bottom ends with a flexible member searingly connected inside the enclosure, the flexible member having top and bottom sides. A drive magnet is connected to the top side of the flexible member. The control apparatus further includes a mounting member carrying a switch and a pivotally mounted driven magnet. The pivotally mounted driven magnet and the drive magnet being positioned and arranged such that when fluid enters the open bottom end of the enclosure and applies pressure to the flexible member, a portion of the flexible member moves from a first position to a second position, carrying the drive magnet and bringing it into a repelling orientation with the driven magnet, which is repelled from the drive magnet and pivotally engages with the switch to operatively change the switch from a first state to a second state. The switch is operably connected to the electrical load device.

17 Claims, 6 Drawing Sheets

NO-FLOAT PUMP SWITCH

STATEMENT REGARDING FEDERALLY SPONSORED RESEARCH

Not Applicable

BACKGROUND OF THE INVENTION

Sumps have been around nearly as long as there have been homes exposed to areas where high water tables exist such as lakes, rivers and those areas where soils or landscaping are unsuitable for adequate drainage. Typically, drain tiles are used to funnel perimeter water into the sump basin. A pump is used to expel the water from the basin. A sump pump switch is used to sense the liquid level and supply current to the pump so that the pump can remove the basin water.

There are various systems used to sense the basin liquid and switch the pump on so that water is expelled. There are vertically actuated float switches, tethered float switches, magnetically actuated reed switches, diaphragm switches, and probe systems.

Some sump pumps that use pump switches with exposed floats can vibrate over into the basin wall causing the float system to fail to operate the pump switch. Floats may also be subjected to debris collection that may cause float system failure. Some product solutions to float related problems have involved floats moving vertically inside a column. The column requires hole(s) to allow the liquid to raise the float. Column holes are subject to blockage by environmental debris.

Other alternatives to float operated systems are diaphragm switches. Diaphragm switches have requirements for a vent tube or breather to relieve the pressure on the non-liquid side of a liquid operated diaphragm. Often the vent tubes/breathers are located where they can get crimped or plugged with debris, insects or objects associated with user curiosity such as inside the power cable. If a sufficient pressure differential is not achieved before the non-liquid side vent is plugged, the diaphragm may not deflect enough to reliably operate the switch within the confines of the basis. All diaphragm switches that directly interface (contact) with a mechanical switching mechanism are subject to the variability in the activation and release forces inherent in the mechanisms. Variability in these forces is inevitable due to the variability in the manufacturing process and the physics associated with contacting mechanical moving parts. When these forces are used to dictate the system on and off set points, these set points will be inconsistent from switch to switch and cycle to cycle. With this kind of variability, in the switching mechanism, the lower level set point shifting too much could cause possible vortexing and cavitating thereby causing pump failure. If the upper level set point shifts too much then the basin could overflow depending on the mounting location of the pump switch which generally is limited to the discharge tube.

Probe systems take advantage of the conductivity of the sump basin water to sense the liquid before switching power to the pump. Since probes are in contact with the sump water, they are also subject to lime and calcium build-up which will not conduct. This loss or increase in impedance through the sump water can cause system failure since current can no longer flow sufficiently to allow sensing of the liquid. If the liquid is not sensed, power can not be switched to the pump so that the pump cannot expel water from the basin.

BRIEF SUMMARY OF THE INVENTION

Noting the observed faults above, the present invention utilizes a flexible diaphragm, waterproof/breathable membrane for pressure relief, and a pair of repelling magnets that are used to reliably and accurately operate a switching mechanism that is dependent on a liquid level. In addition, an air trapping diaphragm retainer is incorporated that assists in controlling the consistency of the pumping range while extending the life of the diaphragm.

The embodiment of the invention provides a control apparatus for turning on and off an electrical control load device after sensing a high and low liquid level in a chamber. The apparatus includes an electrical control circuit and a liquid level sensing apparatus. The liquid level sensing apparatus converts liquid level pressure through the use of a movable diaphragm into a directed internal force used to actuate the electrical control apparatus. The directed internal force is controlled by the characteristics of repelling magnets configured to move such that the magnets axial center lines are aligned at actuation. Before the alignment can occur, the magnets must be offset vertically and horizontally such that the desired actuating force dictates the upper level set point. When in the first position, a high repelling force component impedes activation due to the close proximity of the offset magnets. When a magnitude of force associated with the liquid pressure is sufficient to overcome the repelling force component of the first position, the piston rod translates to the second position. When in the second position and the oriented repelling magnets are axially aligned (while maintaining a greater air gap than when in the first position), the repelling force component is lower than when in the first position. In summary, the repelling force component associated with the offset repelling magnet is greater in the first position than in the second position. The difference between force components (that are perpendicular to the plane of orientation of the diaphragm) while in the first and second positions dictate the pumping range for the load control apparatus.

Before the load control apparatus can be actuated, water pressure must reach a level that provides enough energy to overcome the natural semi-static force associated with the offset repelling magnets. Once this force barrier is overcome, the piston rod with drive magnet accelerates into the actuating position thereby causing near axial alignment of the drive and driven magnets. Once alignment occurs, the primary applied magnetic force vector changes magnitude and direction. The primary applied magnetic opposing force vector changes instantaneously by 90 degrees thereby providing the primary resultant force vector with enough energy to move the load control apparatus actuating member. As the load control apparatus actuating member with mounted driven magnet is repelled away from the drive magnet, the resultant force vector changes, causing the load control apparatus actuating member with mounted driven magnet to rotate to the actuating position. This change in the angular displacement of the axial center lines of the drive and driven magnets produces a component force vector that dictates the lower level set point while in position two. As the liquid level in the chamber is reduced, the water pressure is reduced on the diaphragm. Once the liquid level pressure falls below the threshold of the downward deactivation force component on the drive magnet, the magnets will return to their original offset position and the load control apparatus actuating member will return to its original position thereby causing deactivation of the load control apparatus.

Internal pressure changes caused by the diaphragm's bi-directional motion are vented by a waterproof/breathable membrane. The membrane is protected from premature blockage by environmental debris through the use of an opened bottom, cover. Environmental debris may include but is not limited to dust, dirt, chemicals and surface water particulate. If the electrical load should fail to control a liquid level, the membrane will remain protected from environmental contaminates even if the liquid should encapsulate the entire control apparatus. The low water pressure potential associated with sump basins will not compress the air in the air trapping protective cover to a level that would allow contact of the waterproof membrane.

A feature of the invention is in using a waterproof breathable membrane to relieve the internal pressure created by the motion of the diaphragm. An additional feature of the invention is in utilizing a phenomenon associated with varying magnetic forces as two repelling magnets move in the same plane and perpendicular to their axial center lines to control the accuracy of the upper and lower level set points of the pumping range.

BRIEF DESCRIPTION OF THE SEVERAL VIEWS OF THE DRAWINGS

A detailed description of the invention is hereafter described with specific reference being made to the drawings in which.

DETAILED DESCRIPTION OF THE INVENTION

While this invention may be embodied in many different forms, there are described in detail herein specific preferred embodiments of the invention. This description is an exemplification of the principles of the invention and is not intended to limit the invention to the particular embodiments illustrated.

This invention is shown for sump applications, but it should be understood that it may also be used for other applications such as sewage, potable water or other liquids or fluids, pump up applications and those applications where a bi-directional moving member can be sufficiently directed to cause actuation of a switching mechanism by means of the repelling magnet configuration.

Figure 1:
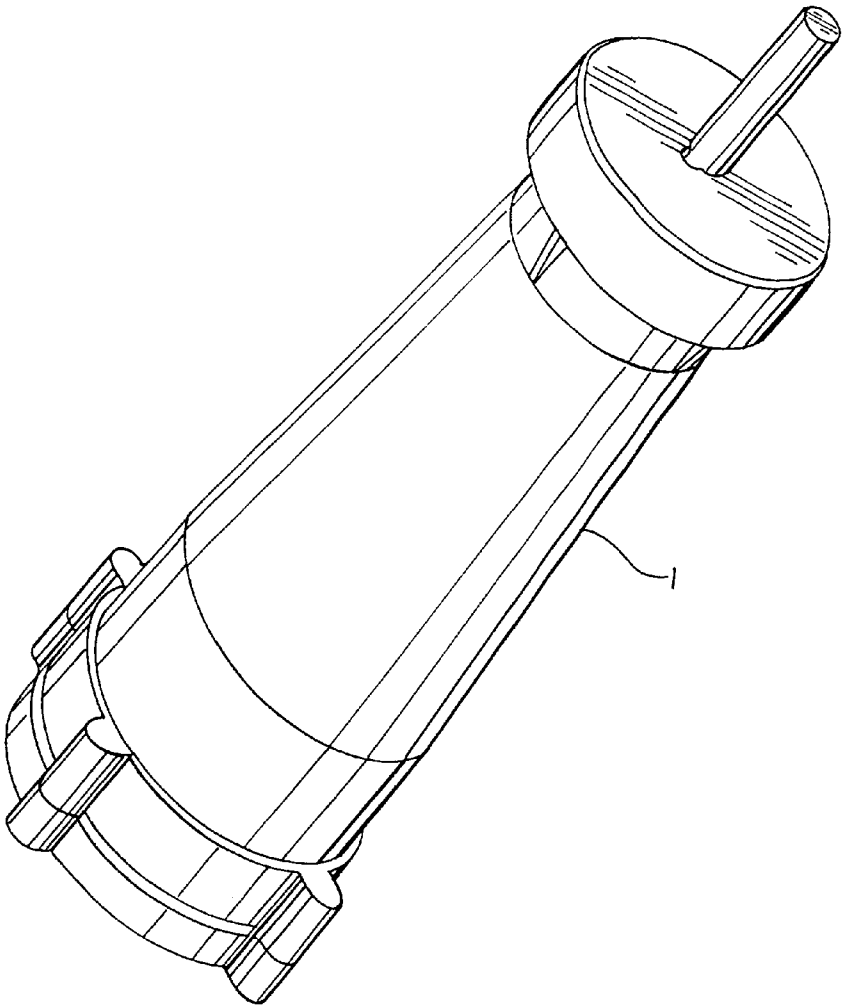
FIG. 1 is a perspective view of the no-float sump switch motor control apparatus.
Figure 2:
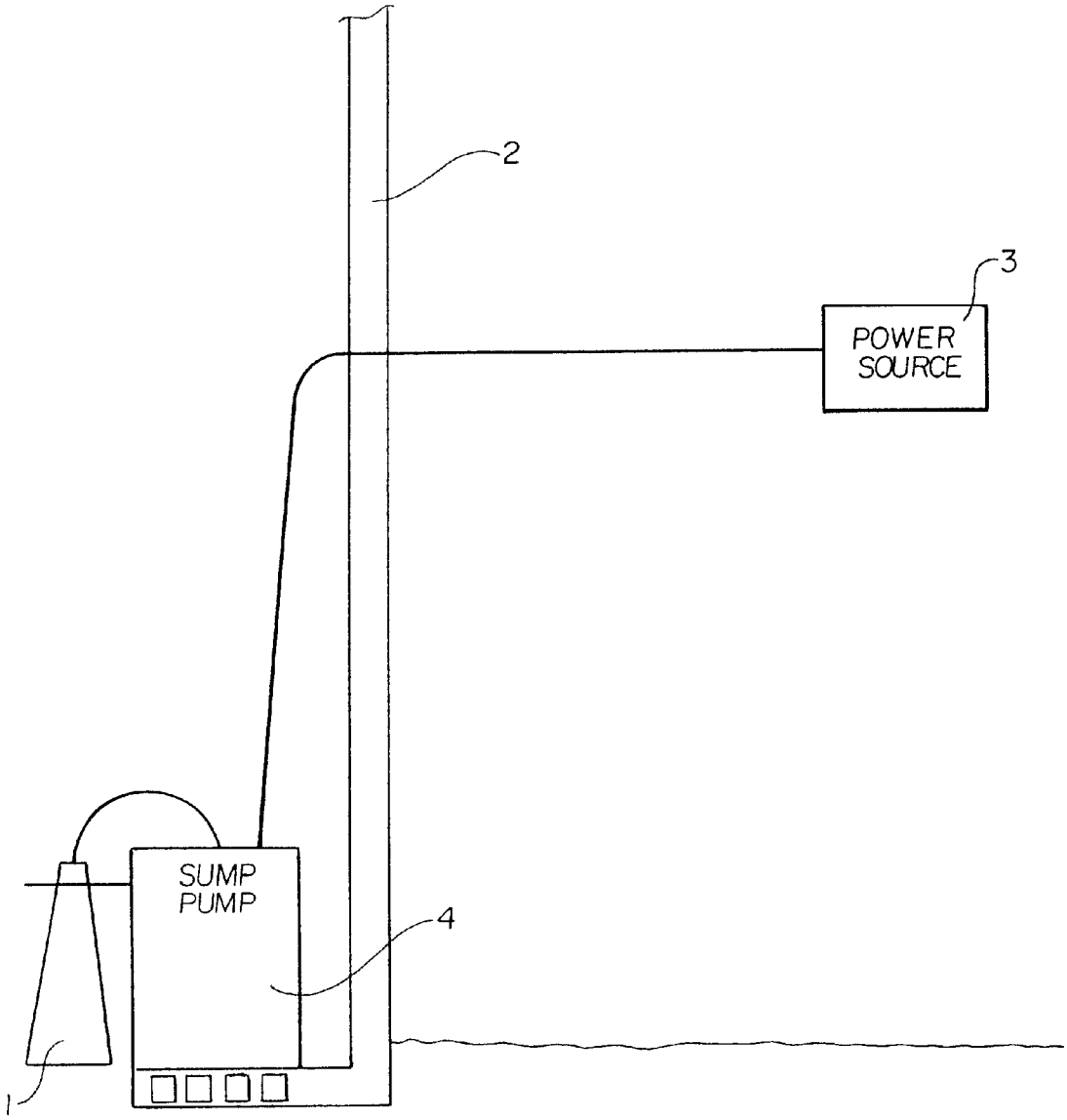
FIG. 2 is a partial cross-sectional view of the no-float sump switch connected to a sump pump.

Referring now to FIGS. 1 and 2, an assembled view of the non-float 1 is shown unattached (FIG. 1) and attached (FIG. 2) to an electrical load device such as sump pump 4, which is powered by power source 3 and connected to discharge tube 2.

Figure 3:
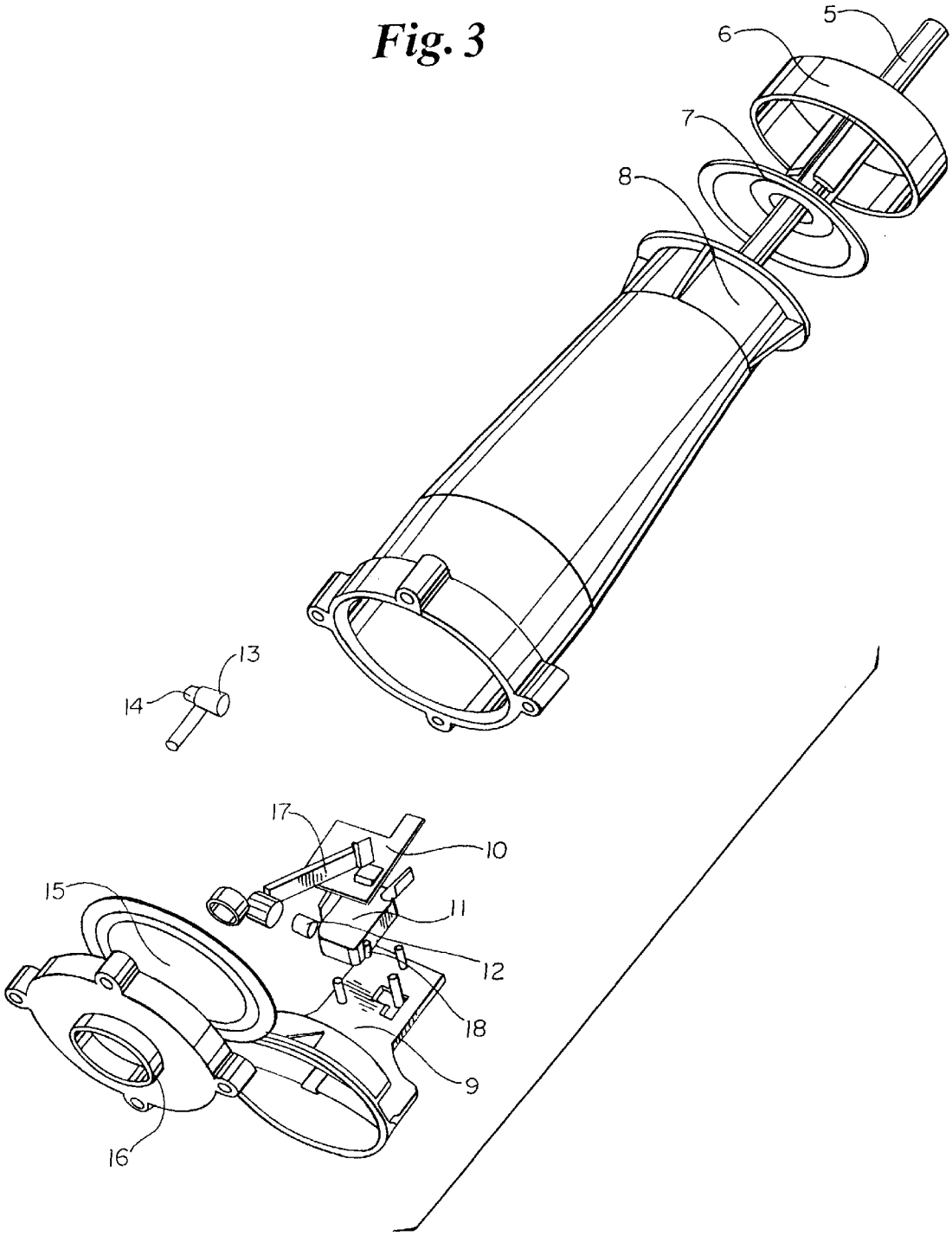
FIG. 3 is an exploded perspective view of the component parts of the no-float sump pump switch.
Figure 4:
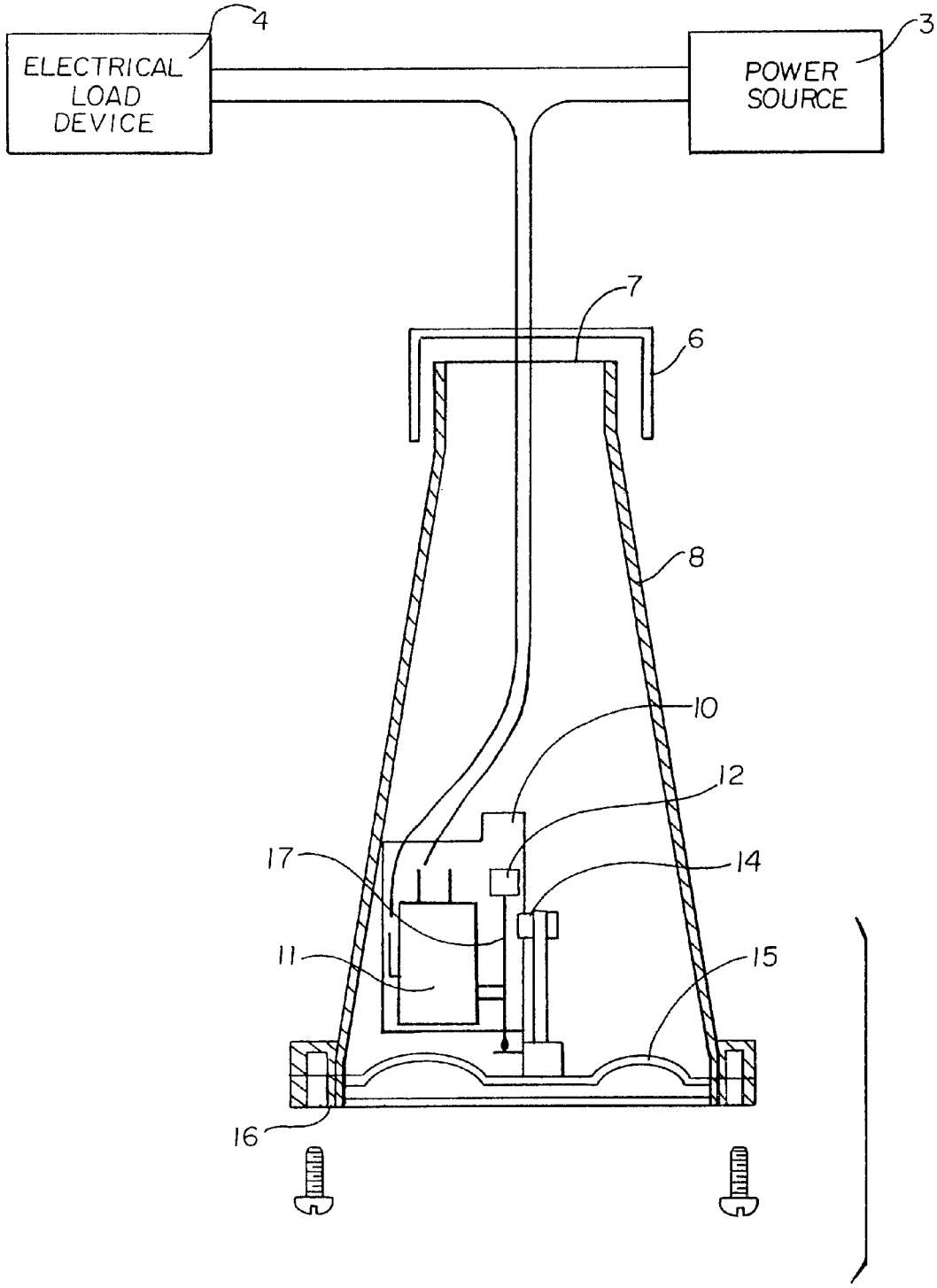
FIG. 4 is a sectional view showing the no-float sump pump switch circuitry.

Referring now to FIGS. 3–5, an electrical control circuit 11 (a snap action switch) is mounted to a mounting block 9. A pivotal lever arm 17 that provides a mechanical advantage is also mounted to the mounting block 9. The pivotal lever arm 17 contacts the snap action switch plunger 18 of the control circuit 11. A driven magnet 12 is attached to the pivotal lever arm 17 so that angular motion is allowed in order to move the switching mechanism 18. A drive magnet 14 is attached to piston rod 13. The piston rod 13 is inserted into the flexing member 15. The flexing member 15 is sealed to the distal end of the enclosure by the attachment of the flexing member retainer 16. Retainer 16 can be screwed to enclosure 8, with the diaphragm trapped in-between to form a seal, or snap-fit connections may be used. The membrane 7 is attached opposite the distal end of the enclosure or cone 8 to provide pressure relief on the internal side of the flexing member 15. Membrane 7 allows the elimination of a vent tube. Vent tubes are used in prior art pressure diaphragm switch designs.

The outside environmental forces apply pressure to the flexing member 15. Once the pressure is sufficient to overcome the semi-static forces associated with the phenomenon of repelling forces as configured in FIG. 5A, the piston rod 13 and drive magnet 14 are accelerated into the position shown in FIG. 5B. In this position the driven magnet 12 has been rotated on a pivotal moving member thereby depressing the snap action switch plunger 18 which activates the sump pump 4. As the driven magnet 12 pivotally rotates to depress plunger 18, the downward force component acting on the drive magnet 14 decreases, because the magnets are moved apart.

Figure 5A:
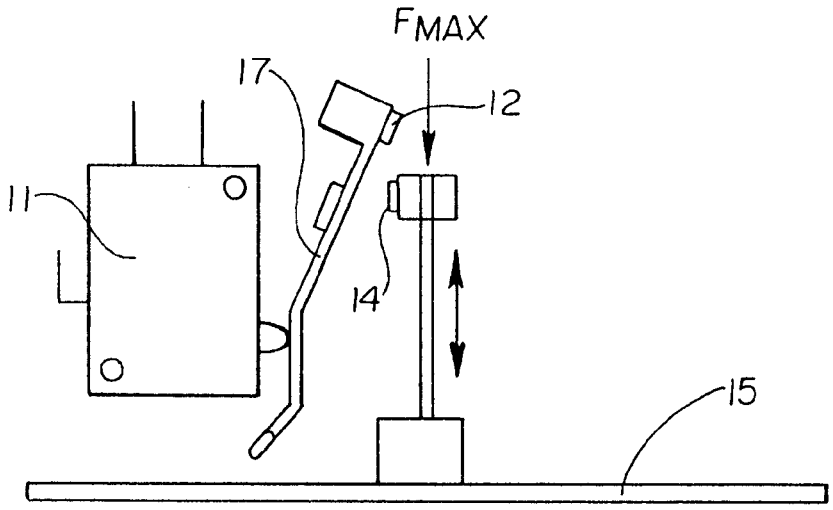
FIG. 5A shows the deactivation position of the switch.
Figure 5B:
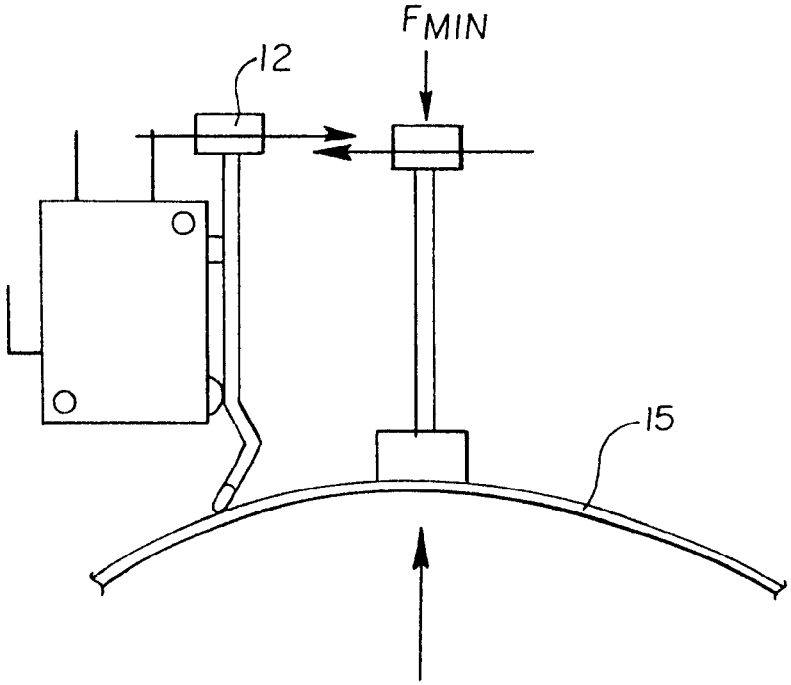
FIG. 5B shows the activation position of the switch.

As the flexing member of diaphragm 15 begins moving, air-flow is passing through the skin-like pores of the membrane 7 thereby relieving back-pressure on the convex side of the flexing member 15 until the position shown in FIG. 5B. The diaphragm 15 can be made of any type of elastomeric or thin metallic material. The membrane 7 is made of an acrylic copolymer or teflon material and can be attached to the cone 8 by any desired means, such as ultrasonic welding or heated die. At the position of FIG. 5B, activation of the sump pump 4 starts the reduction of the applied pressure on the flexing member 15. As the flexing member 15 begins the process of returning to the position shown in FIG. 5A, a lower pressure is produced on the convex side of the flexing member 15. This low pressure causes the outside air to flow in behind the convex side of the flexing member 15, thereby allowing continuous relaxation of the flexing member 15. Once the pressure on the concave side of the flexing member 15 has reduced the forces on the piston rod 13, the piston rod and flexing member 15 will return to the position of FIG. 5A. The transition from the position in FIG. 5B to the position of FIG. 5A is a result of the lower force component (that is perpendicular to the plane of the diaphragm) associated with the position and orientation of the drive magnet 14 and the driven magnet 12, and results in the sump pump 4 turning off.

The cap 6 guides and secures the power cable 5 into the enclosure 8 while protecting the membrane 7 from environmental debris in the air and on the liquids surface. The cap 6 would form an air pocket around the membrane in the event of a power failure thereby protecting the membrane 7 from blockage due to liquid surface particulate. The power cable 5 and the cap 6 are adhered together with the enclosure 8. The power cable 5 is attached to the electrical control device 11. The power cable 5 consists of three conductors (19, 20, and 21) two of which supply current to the electrical load device 4 and the electrical control circuit 11. The conductor 21 is used to provide a grounding circuit while attached to a conductive grounding plate 10. The grounding plate 10 is attached to the mounting block 9 and is secured by the electrical control circuit 11 and the pivotal lever arm 17. The grounding plate 10 is used to prevent shock in the event of a ruptured flexing member 15.

Figure 6A:
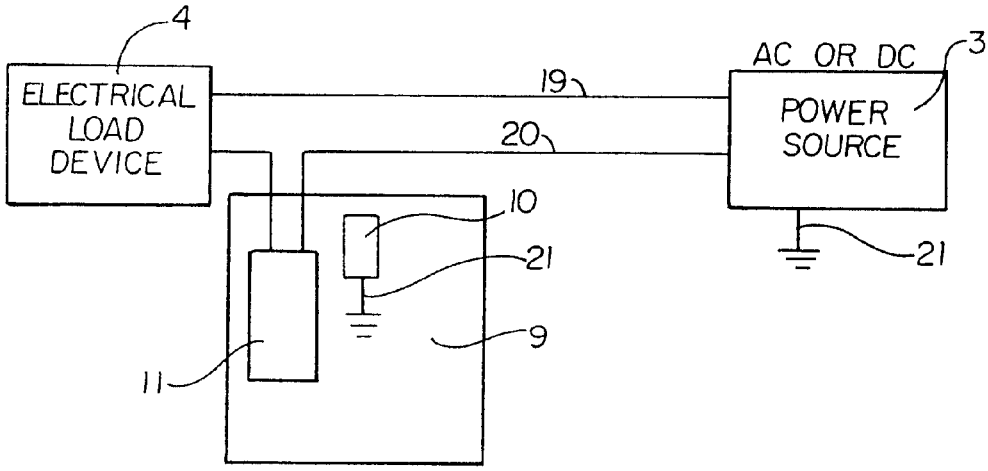
FIG. 6A shows a block diagram of a first embodiment of the circuitry connections.

Referring now to FIG. 6A, a power source 3 is connected to the sump pump 4 and the control circuit 11. Both the circuit 11 and the grounding plate 10 are shown secured to the mounting block 9.

Figure 6B:
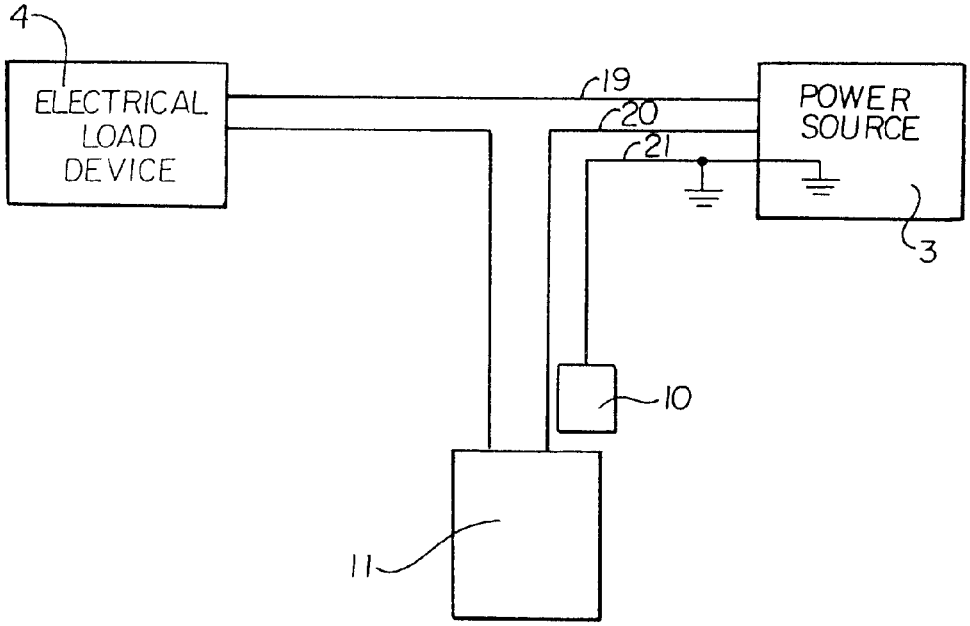
FIG. 6B shows a block diagram of a second embodiment of the circuitry connections.

Referring now to FIG. 6B, a piggyback plug arrangement is shown in which the power source 3 is connected to the sump pump 4 and the control circuit 11. The grounding plate 10 is then attached to the ground of the power source 3.

It should be understood that the pressure diaphragm will work if any type of fluid applies pressure to the diaphragm, whether the fluid is liquid, such as water, or air. In the preferred embodiment, the fluid is air, since this prevents water from coming into contact with the diaphragm. A cushion of air is trapped under the bottom end of the no-float 1, and as the water level rises up the sides of the no-float, more and more pressure is exerted on the diaphragm. It should also be understood that the diaphragm could be positioned at any desired angle inside the enclosure 8, ranging from horizontal to perpendicular and the pressure exerted by the fluid will cause the diaphragm to move and activate the switch.

This completes the description of the preferred and alternate embodiments of the invention. In addition to being directed to the embodiments described above and claimed below, the present invention is further directed to embodiments having different combinations of the features described above and claimed below. As such, the invention is also directed to other embodiments having any other possible combination of the dependent features claimed below. The above examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A control apparatus for turning on and off an electrical load device comprising:

(a) an enclosure having open top and bottom ends;

(b) a flexible member searingly connected inside the enclosure, the flexible member having top and bottom sides;

(c) a drive magnet connected to the top side of the flexible member;

(d) a mounting member carrying a switch and a pivotally mounted driven magnet;

(e) the pivotally mounted driven magnet and the drive magnet being positioned and arranged such that when fluid enters the open bottom end of the enclosure and applies pressure to the flexible member, a portion of the flexible member lifting moves from a first position to a second position, carrying the drive magnet and bringing it into a repelling orientation with the driven magnet, which is repelled from the drive magnet and pivotally engages with the switch to operatively change the switch from a first state to a second state, the switch operably connected to the electrical load device; and (f) an air permeable membrane searingly connected inside the enclosure near the top end, which permits air-flow caused by the portion of the flexible member which lifts towards the top end of the enclosure to pass through the membrane, thereby relieving back-pressure.

2. The control apparatus of claim 1 wherein the fluid is a liquid.

3. The control apparatus of claim 1 wherein the fluid is air.

4. The control apparatus of claim 1 wherein the flexible member is a diaphragm.

5. The control apparatus of claim 4 wherein the switch is a snap action switch actuated by a snap action switch plunger, which is depressed by the driven magnet to operatively change the switch from a first state to a second state.

6. The control apparatus of claim 5 wherein the switch in its second state activates the electrical load device.

7. The control apparatus of claim 5 wherein the switch in its first state deactivates the electrical load device.

8. The control apparatus of claim 5 wherein the switch in its second state deactivates the electrical load device.

9. The control apparatus of claim 5 wherein the switch in its first state activates the electrical load device.

10. The control apparatus of claim 1 wherein the electrical load device is a sump pump.

11. The control apparatus of claim 4 wherein the diaphragm is searingly connected to the enclosure by clamping the perimeter of the diaphragm between the bottom of the enclosure and a diaphragm retainer, the diaphragm retainer having a bottom side with an opening to trap air.

12. The control apparatus of claim 4 wherein the diaphragm is searingly connected to the enclosure by clamping the perimeter of the diaphragm between the bottom of the enclosure and a diaphragm retainer, the diaphragm retainer having a bottom side with an opening to permit egress of liquid.

13. The control apparatus of claim 4 wherein the drive magnet carried by a piston rod is mounted to the top side of the diaphragm.

14. The control apparatus of claim 1 wherein when the switch is in its first state, the drive and driven magnets are positioned and arranged vertically offset and where a predetermined minimum force is required to overcome the semi-static repelling forces to lift the drive magnet so that the drive and driven magnets are vertically aligned, which causes the driven magnet to be repelled from the drive magnet and pivotally engage with the switch to operatively change the switch from a first state to a second state.

15. The control apparatus of claim 14 wherein when the switch is in its second state, the repelling force caused by the drive and driven magnets results in a force component acting on the drive magnet directed toward the bottom of the enclosure, so that when the water pressure is reduced on the flexible member below a predetermined level the magnets will return to their vertically offset positions and the driven magnet will pivotally disengage with the switch to operatively change the switch from its second to its first state.

16. The control apparatus of claim 1 wherein the flexible member is positioned horizontally in the enclosure.

17. The control apparatus of claim 1 wherein the flexible member is positioned non-horizontally in the enclosure.

* * * * *